US007002366B2

(12) United States Patent
Eaton et al.

(10) Patent No.: US 7,002,366 B2
(45) Date of Patent: Feb. 21, 2006

(54) SUPERCONDUCTING CONSTANT CURRENT SOURCE

(75) Inventors: Larry Rodney Eaton, Huntington Beach, CA (US); Mark Winslow Johnson, La Canada Flintridge, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/644,461

(22) Filed: Aug. 20, 2003

(65) Prior Publication Data

US 2005/0040843 A1 Feb. 24, 2005

(51) Int. Cl.
*H03K 19/195* (2006.01)

(52) U.S. Cl. ..... 326/3; 326/6; 327/367

(58) Field of Classification Search ..... 326/1–7; 327/367, 528; 365/162; 505/190
See application file for complete search history.

(56) References Cited

U.S. PATENT DOCUMENTS

| | | | |
|---|---|---|---|
| 4,092,553 | A | 5/1978 | Fang et al. |
| 4,371,796 | A | 2/1983 | Takada |
| 4,501,975 | A | 2/1985 | Josephs et al. |
| 4,785,426 | A | 11/1988 | Harada et al. |
| 5,051,627 | A | 9/1991 | Schneier et al. |
| 5,135,908 | A | 8/1992 | Yang et al. |
| 5,278,140 | A | 1/1994 | Chaudhari et al. |
| 5,411,937 | A | 5/1995 | Wendt et al. |
| 5,560,836 | A | 10/1996 | Nagaishi |
| 5,560,839 | A | 10/1996 | Bennett et al. |
| 5,892,243 | A | 4/1999 | Chan |
| 5,942,997 | A | 8/1999 | Silver et al. |
| 6,127,960 | A | 10/2000 | Silver et al. |
| 6,154,044 | A * | 11/2000 | Herr ..... 326/1 |
| 6,229,332 | B1 | 5/2001 | Herr |

OTHER PUBLICATIONS

Kurosawa et al., "A basic circuit for asynchronous superconductive logic using RSFQ gates", Oct. 1995, Supercond. Sci. Technol. 8 (1995), pp. A46-A49.*

Patel, et al., Self-Shunted Nb/A10$_x$/Nb Josephson Junctions, *IEEE Transactions on Applied Superconductivity*, vol. 9, No. 2, Jun. 1999, pp. 3247-3250.

Feldman, "Josephson Junction Digital Circuits—Challenges and Opportunities", *FED Report*, Feb. 1998, http:/henry.ee.rochester.edu.

* cited by examiner

*Primary Examiner*—Daniel Chang
(74) *Attorney, Agent, or Firm*—Katten Muchin Rosenman LLP; John S. Paniaguas

(57) ABSTRACT

An on-chip current regulator for a superconducting logic circuit isolates the superconducting logic circuit from external noise, reduces the effects of process fluctuations on the performance of the logic circuit and significantly reduces total circuit power requirements. The on-chip current regulator in accordance with the present invention includes one or more hysteretic Josephson junctions each connected in parallel with a resistor forming a resistively shunted junction (RSJ) or includes a self-shunting junction. One RSJ may be coupled between an off-chip current regulator and the hysteretic Josephson junction that functions as a current limiting resistor and provides improved isolation from external noise. One or more RSJs may be coupled between the hysteretic Josephson junction and the superconducting logic circuit which functions as a biasing resistor but at the same time reducing the sensitivity of the superconducting logic circuit to any process fluctuations in the biasing resistor which improves manufacturing yield. In an alternate embodiment of the invention, one or more RSJs can be used in place of the RSJ and the biasing resistor. In another alternate embodiment of the invention, the current regulator is formed from an RSJ and a serially coupled damping impedance.

20 Claims, 3 Drawing Sheets

SUPERCONDUCTING CONSTANT CURRENT SOURCE

BACKGROUND OF THE INVENTION

1. Field of the Invention

The present invention relates to superconducting digital logic circuits and more particularly to a current regulator for superconducting digital logic circuits. This regulator utilizes a non-hysteretic Josephson junction in conjunction with various types of Josephson junction logic to provide constant current control and/or biasing of a superconducting digital logic circuits in order, for example, to improve the noise isolation of the circuit from external noise, to improve the tolerance and the manufacturing yield of such devices to fabrication process variances, and to dramatically reduce circuit bias power consumption.

2. Description of the Prior Art

Josephson junctions, named after Brian Josephson, who predicted the device in 1962, are generally known in the art. Examples of such Josephson junctions are disclosed in U.S. Pat. Nos. 5,411,937; 5,278,140; 5,560,836 and 5,892,243, hereby incorporated by reference. In general, such Josephson junctions include two superconductors separated by an insulating barrier. Such Josephson junctions, are known to be formed on a substrate, such as $SiO_2$, MgO, $LaAlO_3$, YSZ, $SrTiO_3$ and $NdGaO_3$, for example, as disclosed in U.S. Pat. No. 5,560,836. In general, a superconducting material is deposited on the substrate forming two continuous superconducting regions.

Both hysteretic and non-hysteretic Josephson junctions are known. In particular, Josephson junctions formed from various metals or metal oxides having superconducting properties at low temperatures exhibit a characteristic hysteresis effect. More recently, various ceramic materials have been found to exhibit superconductivity at relatively higher temperatures than metals. These ceramic superconductive materials allow operation of the superconducting circuits with relatively lower cooling power requirement and higher overall energy efficiencies. These ceramic based superconductor materials are non-hysteretic.

Josephson junctions are known to be used in signal processing applications, such as in digital logic circuits. In such applications, two or more Josephson junctions are known to be connected together in a superconducting loop forming a superconductive quantum interference device (SQUID). Examples of signal processing circuits formed from Josephson junctions and SQUIDs are disclosed in U.S. Pat. Nos. 4,785,426; 5,942,997; 6,127,960; 5,051,627; 4,371,796; 4,092,553; 6,229,332, and 4,501,975, hereby incorporated by reference.

Two primary types of superconductive digital logic circuits are known; voltage state latching logic and single flux quantum (SFQ) logic. Both voltage state latching logic and SFQ logic require constant current biasing of the Josephson junctions forming the logic circuits. In particular, as shown in FIG. 8, known superconducting logic circuits, generally identified with the reference numeral 99, are powered from an off chip power supply 92, which normally provides a relatively constant voltage to the logic circuit 99. Current from the off chip power supply 92 is limited by a current limiting bias resistor 90. The magnitude of the bias resistor 90 is determined by the isolation requirements between the power source bus 92 and the logic device 99. In particular, the bias resistor 90 is often selected to be relatively large such that the voltage drop across it is 5 to 10 times or more larger than the voltage drop across the Josephson junction logic device 99. This is done to provide constant current to the logic element 99, which is nominally independent of the logic state of device 99 and to isolate the changes occurring in the logic device 99 from the power bus above the resistor 90 and hence isolate the rest of the logic circuit from the logic state of the logic circuit device 99. This method of biasing the logic element is wasteful of the total circuit power.

Unfortunately, during fabrication, the resistance R of the biasing resistor 90 is determined in a completely independent processing step from that which determines the average critical current density Ic of the Josephson junctions forming the logic circuits. Thus, any fabrication process fluctuations affecting the biasing resistor 90 will affect the constant current supplied to the digital logic circuit 99, totally independent of the average critical current density required by the Josephson junctions forming the logic circuit. As such, process fluctuations can significantly reduce the manufacturing yield of such circuits.

One known approach to improve the on-chip voltage/current control to such superconducting logic devices is as shown in FIG. 1. Such superconducting logic devices generally identified with the reference numeral 20, are known to be powered from an off chip power supply 22, which normally provides a relatively constant voltage to the bias resistor of the logic circuit. The distribution of the current from the off chip power supply 22 to the logic gate 20 is known to be regulated on chip by way of a hysteretic Josephson junction 24, a current limiting resistor 26, and a biasing resistor 28. The Josephson junction 24 acts as a constant voltage source (somewhat like a semiconductor zener diode) which latches to the gap voltage $V_G$ of the Josephson junction 24. In its desired operating mode, the hysteretic junction 24 operates along portion 42 of the I/V curve illustrated in FIG. 3. The common node between the Josephson junction 24, current limiting resistor 26 and biasing resistor 28 is held at a relative constant voltage, independent (over a limited operating range) of the changes in the supply voltage 22. This fixed voltage at this node, combined with the fixed bias resistor 28, assures a constant current to the logic element 20. Current from the off chip power supply 22 is limited by the current limiting resistor 26. The magnitude of the biasing resistor 28 determines the current supply to the logic circuit 20 (i.e., $V_G/R$). But for non-hysteretic Josephson junction logic, the regulated voltage of Vg provided by this approach is many times larger than the actual voltage existing across the Josephson junction logic devices, hence, still wasting significant power in the large bias resistor 28, as discussed above, as well as in the relative large regulator current limiting resistor 26 (for which as much as 1.5 times or more power is dissipated above the circuit power requirement). Thus, there is a need to replace these and other passive relatively large resistors with some other means to control the current flow as well as provide the necessary circuit element isolation while at the same time providing a current regulator in which the manufacturing yield is not as dependent upon the processing fluctuation differences between that of thin film resistors used to determine the on chip constant current supply and that of the logic elements.

SUMMARY OF THE INVENTION

Briefly, the present invention relates to an on-chip current regulator for a superconducting logic circuit that isolates the superconducting logic circuit from external noise and reduces the effects of process fluctuations on the performance of the logic circuit. Also, a primary feature of this invention relates to the reduction of the bias power to nominally around that of the circuit element rather than 5 to 10 times this value. The on-chip current regulator in accordance with the present invention includes one or more Josephson junctions, in parallel with a resistor forming a non-hysteretic resistively shunted junction (RSJ) or a self shunting, naturally "non-hysteretic" junction that does not require a separate parallel resistor. One non-hysteretic junction may be coupled between an off-chip current supply and a Josephson junction circuit element to provide improved isolation from external noise, improved tolerance to process variations, and significant reduction in total circuit power requirement. One or more non-hysteretic junctions may be coupled between superconducting logic circuit elements to reduce the sensitivity of the circuit to process fluctuations in the connecting resistor, thereby improving the manufacturing yield. In an alternate embodiment of the invention, one or more RSJs can be used in place of the RSJ and the biasing resistor. In another alternate embodiment of the invention, the current regulator is formed from an RSJ and a serially coupled damping impedance.

DESCRIPTION OF THE DRAWINGS

These and other advantages that the present invention will be readily understood with reference to the following specification and attached drawing wherein.

DETAILED DESCRIPTION

Figure 1:
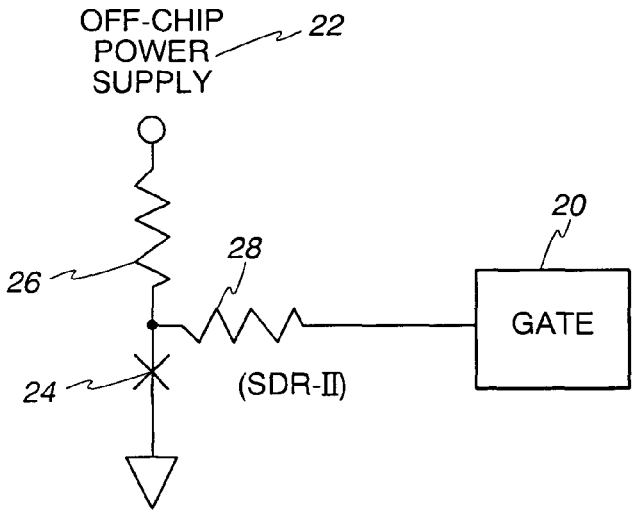
Fig. 1 (Prior Art)
FIG. 1 is a schematic diagram of a known voltage regulator circuit for providing a controlled current supply to superconducting logic circuits.
Figure 4:
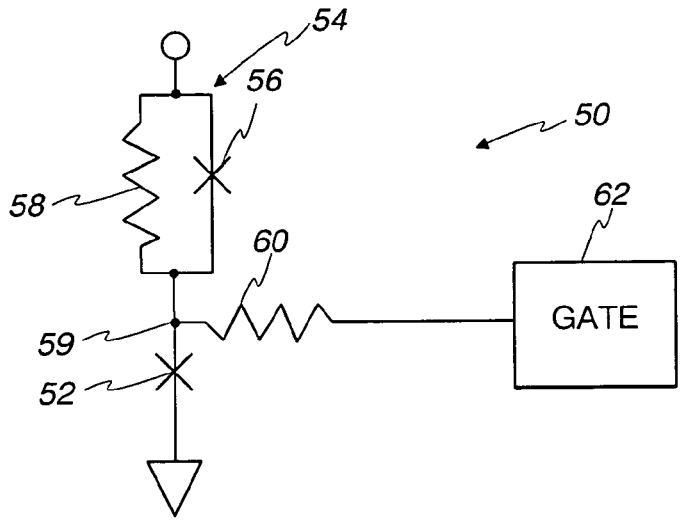
FIG. 4 is a schematic diagram of a current regulator in accordance with one aspect of the present invention illustrating the use of a RSJ in place of a current limiting resistor.
Figure 5:
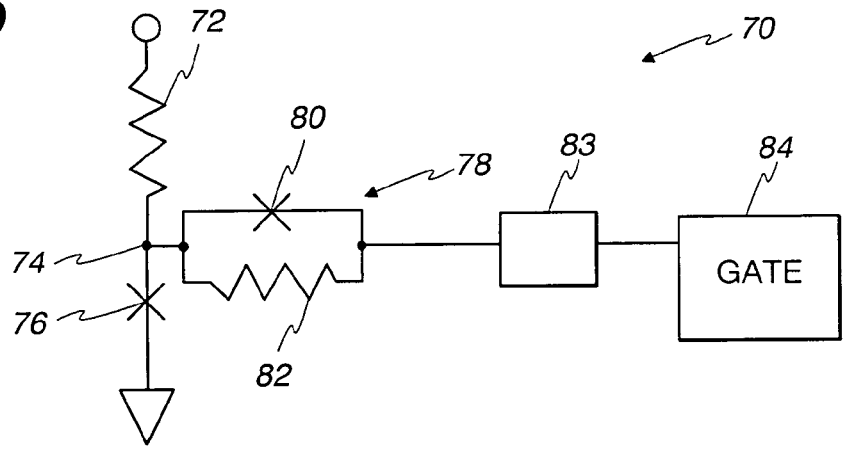
FIG. 5 is a schematic diagram of an alternate embodiment of the invention illustrating the use of an RSJ and damping impedance in place of a biasing resistor.
Figure 6:
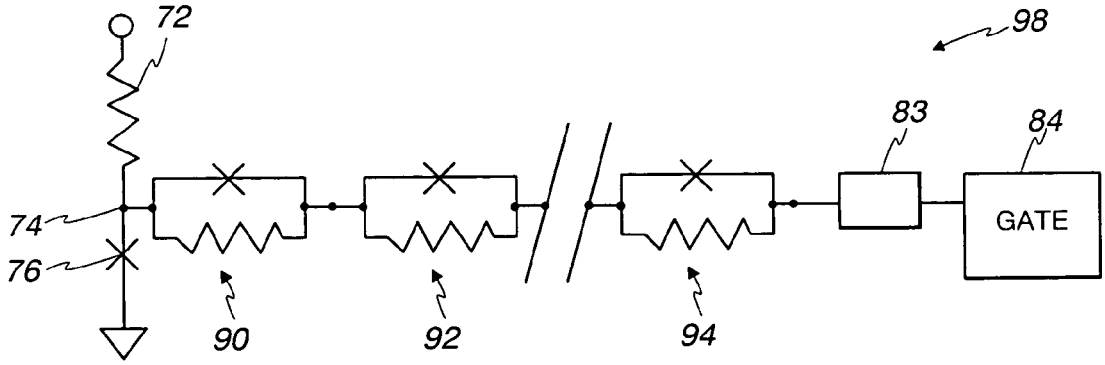
FIG. 6 is a schematic diagram of an alternate embodiment of the invention illustrating the use of multiple RSJs.
Figure 7:
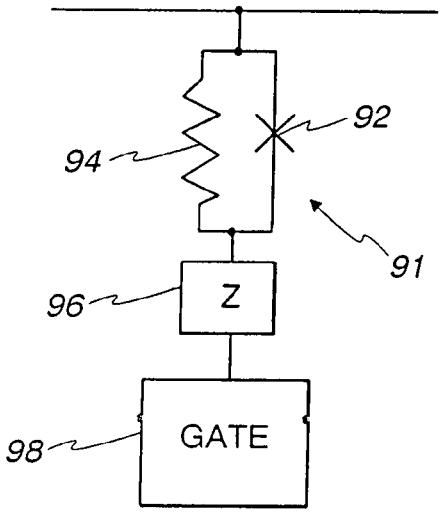
FIG. 7 is a schematic diagram of an alternate embodiment of the invention formed from an RSJ and a damping impedance which significantly reduces the power of the logic circuit elements.

The present invention relates to an on chip current regulator for use with superconducting logic circuits that is able to provide isolation from external noise and also reduces the logic element sensitivity to fabrication process variations of the bias resistors presently used to form the on-chip current regulation. The principles of the present invention are suitable for use with any known superconducting logic circuits, such as voltage state latching logic and single quantum (SFQ) logic circuits, which require a constant current source for proper operation. In one embodiment of the invention, as shown in FIG. 4, a resistively shunted junction(s) (RSJ) or other non-hysteretic Josephson junction(s) is used in place of the current limiting resistor 26 discussed above. In alternate embodiments of the invention, as illustrated in FIGS. 5 and 6, one or more RSJs are used in place of the biasing resistor 28. Alternatively, one or more RSJs can be used in place of both the current limiting resistor 26 and the biasing resistor 28 of FIG. 1. FIG. 7 illustrates an embodiment in which the current regulator is formed from an RSJ and a serially coupled damping impedance.

As discussed above, hysteretic Josephson junctions are normally utilized with superconducting logic circuits to form a voltage regulator for superconducting logic circuits. In particular, such superconducting logic circuits include an on chip current regulator which includes a hysteretic Josephson junction, a current limiting resistor and a biasing resistor as discussed above. In accordance an important aspect of the invention, a Josephson junction is used to form an on chip current regulator that is not only tolerant of off chip noise but also desensitizes the on-chip current regulator to process fluctuation in the resistors, formed during different processes than the Josephson junctions. As will be discussed in more detail below, the current regulator junction is made during the same process steps as the Josephson junctions forming the logic circuits. Thus, any process fluctuations in the current regulator junction will also occur in the gate junctions of the logic circuitry. As such, process fluctuations will generally affect the supply and demand of current in the logic circuit equally, thereby providing for self-compensation of any process fluctuations, and consequently yielding a larger fraction of usable circuits.

Figure 2:
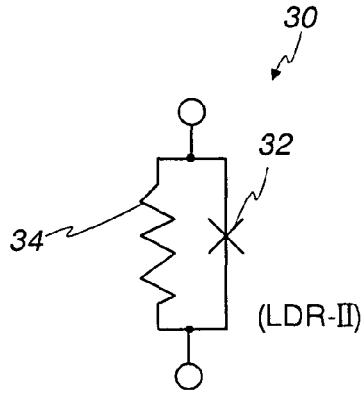
FIG. 2 is a schematic diagram of a resistively shunted junction (RSJ) in accordance with one embodiment of the present invention.
Figure 9:
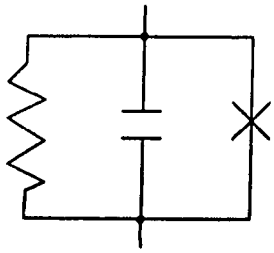
FIG. 9 is a schematic diagram of the electrical equivalent circuit of a biased Josephson junction in accordance with the present invention.

Referring to FIG. 2 a resistively shunted junction (RSJ) 30 in accordance with the invention is illustrated. The RSJ 30 includes a Josephson junction 32, for example, a non-hysteretic Josephson junction formed from a Josephson junction and a resistor 34, connected in parallel. Such a device has a equivalent circuit as illustrated in FIG. 9. Although the invention is discussed in terms of an RSJ, a self shunting or naturally non-hysteretic junction which does not require a parallel resistor which has an I-V characteristic similar to the solid curves shown in FIG. 3 can alternatively be used. In accordance with the present invention, such a self shunting junction can be used without a separate parallel resistor. An example of such a self shunting junction is disclosed in Patel et al., "Self-Shunted Nb/A$10_8$/$N_b$ Josephson Junctions", *IEEE Transactions on Applied Superconductivity,* Vol.9, No. 2, June 1999, pages 3247–3250, hereby incorporated by reference. As will be discussed in more detail below, the RSJ 30 may be used to replace the current limiting resistor 26, as shown in FIG. 4, and/or may be used to replace the biasing resistor 28, as shown in FIGS. 5 and 6 in a known current regulator as discussed above. This RSJ 30, more importantly, can replace the bias resistors as shown in FIG. 7 that are often used for Josephson junction logic in such a way to dramatically reduce the total power consumption relative to known circuits.

Figure 3:
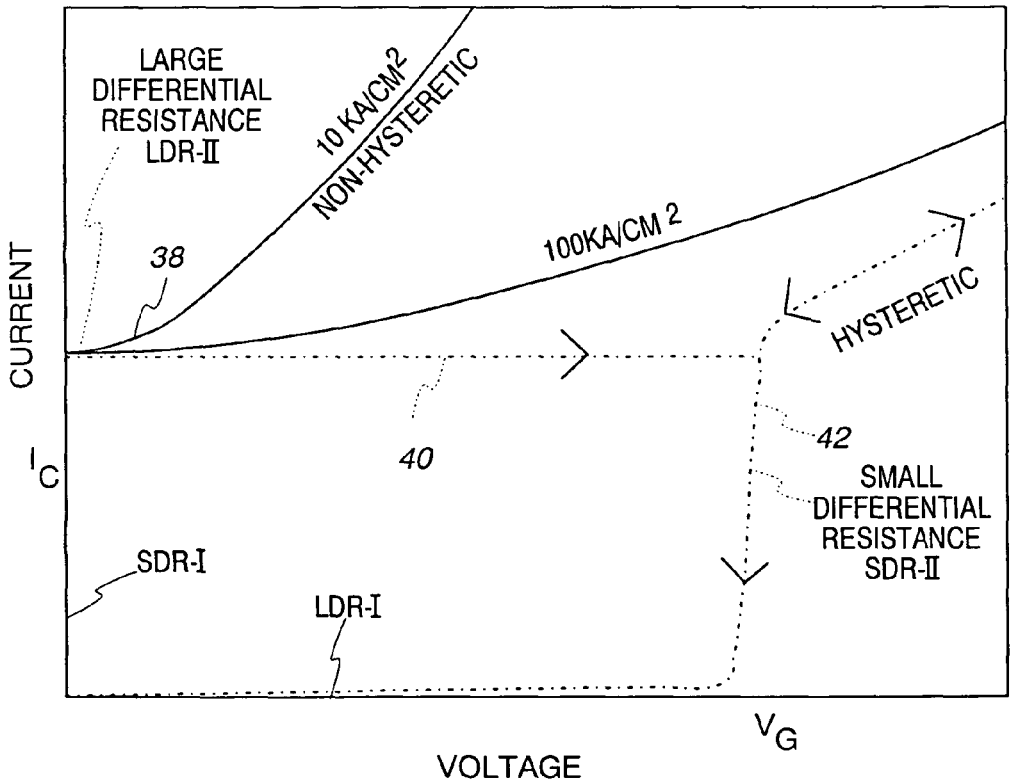
FIG. 3 is a graphical illustration of the I-V characteristics of a resistively shunted junction (RSJ) incorporating a non-hysteretic junction, shown in solid line and the I-V characteristics of a hysteretic junction shown in dashed lines.

The present invention is best understood with reference to FIG. 3, which illustrates the I-V characteristic of an RSJ incorporating a non-hysteretic Josephson junction illustrated by a solid lines 38 and the I-V characteristics of a hysteretic Josephson junction, shown by way of the dashed line 40. As shown, the hysteretic Josephson junction operates in a portion 42 of the characteristic curve 40 in which the junction has a relatively small differential resistance. When the hysteretic Josephson junction is biased in this portion 42 of the curve 40, it behaves virtually as a nearly ideal voltage source. As such, the voltage $V_G$ of the hysteretic junction is relatively constant, independent of the current as described in U.S. Pat. No. 3,696,287 to Silver, et. al, hereby incorporated by reference.

In contrast a non-hysteretic Josephson junction functions as a relatively large differential resistance as evidenced by the characteristic curve 38 and essentially behaves nominally as a current source from V approximately equal to zero to voltages somewhat less than $V_G$. As shown, the current is relatively constant at lower voltages. These characteristics are used to improve the noise tolerance and manufacturing yield of superconducting logic circuits with on-chip current regulators as discussed below. More importantly, the use of the portion of the curve for the voltage drop across the regulator approaching zero voltage permits significant reduction in circuit power consumption while still providing the noise tolerance and yield attributes mentioned previously.

The characteristics of the current regulator is primarily controlled by the properties of its I/V curve. Below the critical current Ic of the regulator, there is no voltage associated with the current flow which is passed on to the circuit being controlled. Above the regulator critical current Ic, the regulator starts to drop voltage as the current tries to increase, hence attenuating the current changes seen by the circuit being controlled. Ideally, this portion of the I/V curve would be "flat", so that there is no increase in current flowing through it as the voltage drop across it increases. But as seen in the FIG. 3, which illustrates the regulator I/V curve, the curve of a non-hysteretic Josephson junction increases gradually, then more rapidly, eventually having a slope related to the shunt resistor used to critically or over-damp the regulator Josephson junction. The total current in this portion of the I/V curve is composed of the d.c. portion equal to the Ic of the junction plus an a.c. portion resulting from the voltage bias across the regulating junction, both properties of Josephson junction technology. For the application of replacing the bias resistor of SFQ logic, a pure d.c. current is desired. This can be achieved by the use of reactive elements that smoothes and/or shunts the a.c. portion of the current. Loss-less capacitive and inductive elements can be used. In this case it has been found that inductive smoothing/filtering is effective. As noted, with the present state of the art of non-hysteretic junctions, the useful range of the portion of the curve 38 is somewhat limited. Nominally it is sufficient for RSJ logic, but requires the use of multiple Josephson junctions for use with hysteretic logic.

The following design variables can be used to shape this portion of the I/V curve. Extension of the relative "flat" portion of the curve further enhances the already significant regulator benefits of immunity of the regulated circuit to external noise, power source fluctuations, and reduction of total power consumption.

The current regulator utilizes a shunted (either natural or fabricated) Josephson junction as the basic dynamic element. The RSJ equivalent circuit contains a shunt resistor, a parallel capacitor, both across an ideal Josephson junction as illustrated in FIG. 9. A primary controlling relationship is:

$$\text{Beta-}c(Ic\hat{}2, R, Jc, C')=(4*Pi*e/h)*(Ic*R)\hat{}2*(C'/Jc)$$

Where

Pi=π=3.141- - - e=charge of an electron h=Boltzman constant

Ic=The JJ critical current

R=The effective shunt resistance (composed of parallel resistances of the insulator leakage reistance, the quasi-particle current conductance, and the shunt resistance).

C'=Capacitance per unit area of the JJ junction

Jc=The critical current density of the JJ (where Jc*A=Ic)

A=The JJ cross section area

For an over damped Josephson junction, Beta-c is <or =1, being close to 1 for a critically damped junction.

Assuming that Beta-c is fixed, the variables available to shape the I/V curve of a damped Josephson junction are Ic, R, C', and Jc.

C': For a given fabrication process, C' is nominally independent of the other parameters (varying logarithmically with Jc, i.e., with the tri-layer dielectric thickness). On the other hand, other materials, such as semiconductor, have been used as the barrier material which give significant larger thickness, hence decreasing C' proportional to the increase in thickness.

Ic: Ic can be varied by design, the lower value being primarily limited by thermal noise associated with the current. Nominal Ic's vary from, but not limited to, a few tens of microamps to a few milliamps.

Jc: The larger Jc is, the faster the circuits function. The upper limit on Jc is primarily a fabrication tools/process controlled. The nominal demonstrated range for Jc is few hundred amps/cm2 to tens of 1,000 amps/cm2, but is being continuously pushed upwards for higher clock speed logic.

R: The shunt resistance portion of R is presently primarily controlled by design. From other analysis for this application of Josephson junction technology, the larger the value of R is, the larger the current control range will be. Hence, an approach is to vary the other parameters in the above equation such that R can be maximized, that is decrease Ic and C' while increasing Jc within the constraints given above.

Stacked Josephson junctions: Another variable that can extend the regulation operating range is that of stacking regulation Josephson junctions, hence increasing the total Vg of the combination, and consequently further "flattening" the regulator I/V curve more over an extended voltage range.

Looking more closely at the critically, and/or over-damped Josephson junction I/V curve, the current for I>Ic is composed of a) a "d.c." component equal to Ic, and b) an "a.c." component which is a function of the voltage imposed across the Josephson junction of the current regulator. In principle, by use of inductive/capacitive filtering, all of the current passing through the "regulator" can be utilized in the circuit being controlled. (Although pure resistive elements are usually avoided in superconductive circuits due to their power dissipative properties, some use of them is sometimes necessary to control parasitic circuit oscillations and to avoid flux trapping within superconductive loops.) However, further I/V curve shaping which provides extension of the operating dynamic range can be achieve by the shunting some or all of the voltage related "a.c." current around the circuit being tested. Whatever fraction of this a.c. component of the current that can be shunted around the circuit being controlled will extend the effective current regulation range. Note: this "a.c." content goes from a very low pulse repetition rate (essentially zero frequency at very low voltage bias) to 100s of GHz as the voltage bias approaches Vg (the gap voltage of the regulator Josephson junction). Although this a.c. current shunting will increase the power dissipation of the system, it may well be worth that trade for increase margins on a complex system (note that this shunted current/power can still be very low compared with the dissipation associated with a fixed resistor bias approach).

Various exemplary applications of the current regulator in accordance with the present invention are contemplated as set forth below.

Logic element bias (FIG. 7): The current regulator can be used to replace the fixed bias resistor to each, or group, of superconductor circuit logic elements. Appropriate design including isolation/damping elements can reduce the power consumption of a single flux quantum (SFQ) circuit by and order of magnitude or more.

Voltage regulation: The current regulator can be used to replace the fixed resistor of the superconductor voltage regulator. As with the semiconductor circuits, this will further enhance the quality of the voltage regulation. (FIG. 4)

Current coupling: The current regulator can also be used to replace some of the other resistors that are used in superconductor circuits. For example, the shunted, regulator circuit element can be used to replace resistors in the superconductor circuits whose function is to control the current flow between circuit elements, for example, replacing the current limiting resistor between logic stages of a MVTL and other classes of superconductor circuits. This resistor replacement approach is most compatible for those instances where the expected voltage drop across the regulator is some fraction of its Vg, although stacking of shunted Josephson junctions can extend the voltage range to which this element can be applied.

One embodiment of a current regulator for a superconducting logic circuit in accordance with the present invention is illustrated in FIG. 4. This embodiment, illustrated with the reference numeral 50, includes a non-hysteretic Josephson junction 56 and a resistor 58 forming a current limiting resistively shunted junction (RSJ) 54. The resistor 58 may be a thin film resistor and connected in parallel with the non-hysteretic Josephson junction 56. The RSJ 54 is connected between an external power source and more particularly to an off-chip voltage regulator (not shown) and a hysteretic Josephson junction 52 at a common node 59. A biasing resistor 60 is connected between the node 59 and a superconducting logic circuit 62 as discussed above. In this embodiment, the RSJ 54 improves the noise isolation of the on-chip current regulator. In particular, as discussed above, the I-V characteristics of the RSJ 54 are parabolic as illustrated in FIG. 2. By operating the RSJ 54 in the portion 38 of the characteristic I-V curve, the current output of the RSJ 54 will be quasi-constant. As such, the RSJ 54 itself will provide current regulation, thus improving the overall current regulation of the on-chip current regulator.

In an alternate embodiment of the invention as illustrated in FIG. 5, a constant regulator 70 is disclosed. The current regulator 70 includes a current limiting resistor 72, connected between an off chip current supply (not shown) and a node 74. A hysteretic Josephson junction 76 is connected between the node 74 and ground. An RSJ 78, which includes a non-hysteretic Josephson junction 80 and a parallel resistor 82 is coupled between a superconducting logic gate 84 and the node 74. In this embodiment, a damping impedance 83 may be required to prevent oscillation of the RSJ. In particular, RSJs are known to oscillate at a frequency proportional to the voltage across them. As such, it may be necessary to dampen/filter these oscillations so that they do not influence the biasing of the logic circuit. The damping/filtering impedance 83 can be various devices including a series inductance, shunt capacitance and/or a small series resistance in combination to form a low pass filter.

In the embodiment illustrated in FIG. 5, the RSJ 78 is used in place of the biasing resistor 23 (FIG. 1) and is used to reduce the sensitivity of the chip to circuit fabrication process fluctuations of thin film resistors, such as the resistor used for the bias resistor 28 produced during processing stages other than the processing stages for the Josephson junctions. As discussed above, the RSJ 78 is operated in the portion 38 (FIG. 3) of the characteristic curve. As shown in FIG. 3, at operating voltages in a region less than $V_G$, the current is relatively constant, thus desensitizing the regulator to such fabrication process fluctuations. Since the RSJ is made during the same process steps as the superconducting logic circuit, any fluctuations in the regulator circuit affecting the supply of current will also affect the logic circuit and thus the demand for the current, hence being somewhat self compensating for these fabrication variances.

The current regulator in accordance with the present invention should be operated in the highest differential resistance portion of its I-V characteristic. As such, the RSJ must not be required to take up too much of the difference between a latching voltage Vg and the operating voltage on the gate. As such, as illustrated in FIG. 6, multiple RSJs 90, 92 and 94 may be used as shown in the regulator 98 where control over larger voltage range is required.

Figure 8:
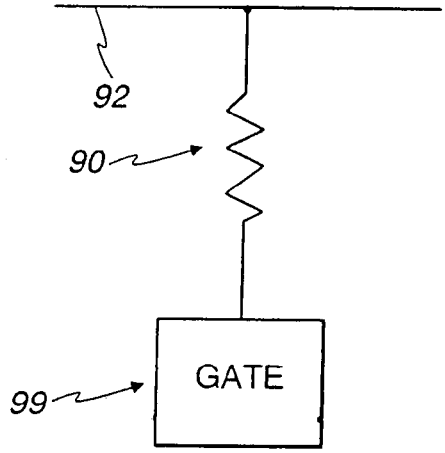
(Prior Art) Fig. 8
FIG. 8 is a schematic diagram of the prior art illustrating the biasing a logic element with a large bias resistor and an external power source.

In the embodiment illustrated in FIG. 7, the RSJ 91 is used in place of the fixed biasing resistor 90 of FIG. 8. The RSJ 91 is formed from a Josephson junction 92 and a shunt connected resistor 94. A damping impedance 96 may be disposed between the RSJ 91 and the gate 98. The RSJ 91 is used to reduce the bias bus voltage to that comparable to twice or less than that of the gate 98, rather than the 5× to 10× nominally required for the circuit configuration of FIG. 8. Not only is the circuit power consumption proportionally reduced, but enhanced noise suppression and increased fabrication variance tolerance are achieved. For some of the SFQ logic circuit designs in present art, this current regulator can reduce the power consumption by much more that an order of magnitude. In many cases, the use of this invention will reduce the necessary circuit power dissipation to much less than or equal to about a factor of two of the ultimate minimum power possible for this very low power, ultra high speed integrated circuit technology.

Obviously, many modifications, combinations, and variations of the present invention are possible in light of the above teachings. Thus, it is to be understood that, within the scope of the appended claims, the invention may be practiced otherwise than as specifically described above.

What is claimed is:

1. A current regulator for a regulated superconducting logic device with an on-board current regulator adapted to be powered by an external power supply, the current regulated superconducting logic device comprising:

a non hysteretic Josephson junction coupled between said external power supply and a node;

a hysteretic Josephson junction coupled between said node and ground; and a biasing resistor coupled to said node and said superconducting logic device.

2. The current regulator as recited in claim 1, wherein said non hysteretic junction includes a hysteretic Josephson junction coupled in parallel with a resistor forming a resistively shunted junction (RSJ).

3. The current regulator as recited in claim 1, wherein said non-hysteretic junction is a self shunting junction.

4. The current regulator as recited in claim 1, wherein said biasing resistor is a thin film resistor.

5. A current regulator for a superconductivity logic device adapted to be powered by an external power supply, the current regulator comprising:

a current limiting resistor coupled between said external power supply and a first node;

a hysteretic Josephson junction coupled between said node and ground;

a first non hysteretic junction coupled between said first node and a second node; and a damping impedance coupled between said second node and a superconducting logic device.

6. The current regulator as recited in claim 5, wherein said non-hysteretic junction includes a hysteretic junction coupled in parallel to a resistor forming a resistively shunted junction (RSJ).

7. The current regulator as recited in claim 5, wherein said non-hysteretic junction is a self shunting junction.

8. The current regulator as recited in claim 5, wherein said damping impedance includes a series inductance.

9. The current regulator as recited in claim 5, wherein said damping impedance includes a shunt capacitance.

10. The current regulator as recited in claim 5, wherein said damping impedance includes a resistance.

11. The current regulator as recited in claim 5, wherein said damping impedance includes a low pass filter.

12. The current regulator as recited in claim 5, further including one or more additional non-hysteretic junctions serially coupled to said first non-hysteretic junction between said first node and said second node.

13. A current regulator for a superconducting logic device adapted to be powered by an external power supply, the current regulator comprising:

a non hysteretic junction coupled between said external power supply and a node; and a damping impedance in series with said non hysteretic junction and coupled between said node and said superconducting logic device.

14. The current regulator as recited in claim 13, wherein said non-hysteretic junction includes a hysteretic Josephson junction coupled in parallel to a resistor forming a resistively shunted junction (RSJ).

15. The current regulator as recited in claim 14, wherein said resistor is a thin film resistor.

16. The current regulator as recited in claim 13, wherein said non-hysteretic junction is a self-shunting junction.

17. The current regulator as recited in claim 13, wherein said damping impedance includes a series inductance.

18. The current regulator as recited in claim 13, wherein said damping impedance includes a resistance.

19. A current regulator for a superconducting logic device adapted to be powered by an external power supply, the current regulator comprising:

a non hysteretic junction coupled between said external power supply and said node; and a damping impedance coupled between node and said superconducting logic device, wherein said damping impedance includes a shunt capacitance.

20. A current regulator for a superconducting logic device adapted to be powered by an external power supply, the current regulator comprising:

a non hysteretic junction coupled between said external power supply and said node; and a damping impedance coupled between said node and said superconducting logic device, wherein said damping impedance includes a low pass filter.

* * * * *